US006945391B2

(12) United States Patent
Moodie

(10) Patent No.: US 6,945,391 B2
(45) Date of Patent: Sep. 20, 2005

(54) CONTAINERS AND METHOD FOR MANUFACTURING CONTAINERS

(75) Inventor: Malcolm Melsetter Moodie, Pretoria (ZA)

(73) Assignee: Flexi-Pac (Pty) Ltd. (ZA)

( * ) Notice: Subject to any disclaimer, the term of this patent is extended or adjusted under 35 U.S.C. 154(b) by 246 days.

(21) Appl. No.: 10/149,646

(22) PCT Filed: Dec. 14, 2000

(86) PCT No.: PCT/ZA00/00252

§ 371 (c)(1),
(2), (4) Date: Oct. 9, 2002

(87) PCT Pub. No.: WO01/44071

PCT Pub. Date: Jun. 21, 2001

(65) Prior Publication Data

US 2003/0089625 A1 May 15, 2003

(30) Foreign Application Priority Data

Dec. 14, 1999 (ZA) ..... 99/7679
Nov. 20, 2000 (ZA) ..... 2000/6759

(51) Int. Cl.[7] ..... B65D 35/08

(52) U.S. Cl. ..... 206/204; 206/824; 222/107; 222/541.6

(58) Field of Search ..... 222/92, 107, 541.6; 206/824, 204

(56) References Cited

U.S. PATENT DOCUMENTS 3,834,606 A * 9/1974 Andersson ..... 229/406
3,986,640 A 10/1976 Redmond
4,236,652 A 12/1980 Beguhn et al.
4,493,574 A * 1/1985 Redmond et al. ..... 401/132
5,165,800 A * 11/1992 Downey ..... 383/78
5,395,031 A * 3/1995 Redmond ..... 222/541.6
5,437,881 A 8/1995 Jeannin
5,494,192 A 2/1996 Redmond
5,992,628 A 11/1999 Vermilion et al.

FOREIGN PATENT DOCUMENTS

WO 9629262 9/1996
WO 9706073 2/1997

* cited by examiner

*Primary Examiner*—Jacob K. Acun, Jr.
(74) *Attorney, Agent, or Firm*—McDonnell Boehnen Hulbert & Berghoff, LLP

(57) ABSTRACT

This invention provides a container (10) in the form of a sachet having a body (11) defining a reservoir (12). The body (11) includes a flexible first wall (13) having a line of weakness (14), and a relatively more flexible second wall (15) sealingly joined to the first wall (13), along its periphery. The line of weakness (14) is configured to open up to form an opening in the first wall (13) when the first wall (13) is folded about the line of weakness (14). The invention is characterised in that the line of weakness (14) is bent, resulting in the advantages that the first wall (13) opens in a controlled fashion and the container (10) is able to withstand relatively rough handling and a substantial amount of bending, without the first wall (13) opening accidentally along the line of weakness (14).

11 Claims, 8 Drawing Sheets

CONTAINERS AND METHOD FOR MANUFACTURING CONTAINERS

INTRODUCTION AND BACKGROUND TO THE INVENTION

This invention relates to containers and to a method for manufacturing containers. More particularly, but not exclusively, this invention relates to a sachet for storing and dispensing liquids, pastes, powders or similar substances.

A number of different types of breakable sachets are known in the art. These include sachets having a relatively flexible pouch adhered to a flexible relatively stiffer material, the stiffer material having a linear line of weakness therein, allowing opening of the sachet by folding the container about the line of weakness, thus breaking the stiffer material along such line.

These types of sachets tend to suffer from the disadvantage that in order to manufacture such sachets to be robust enough to withstand the rigors of transit or storage, they must have a degree of resistance to breakage, rendering them difficult to break open in a controlled manner as intended.

A number of solutions for facilitating breakage of such sachets have been proposed, including those disclosed in PCT application PCT/NZ96/00078 and U.S. Pat. No. 4,493,574. The proposed solutions suffer from the disadvantages of requiring relatively complex manufacturing techniques and therefore being relatively more expensive to produce, and/or rendering controlled dispensing of the contents of the sachet difficult.

Another disadvantage of the known containers is that pressure is built up inside the container when the container is folded about the line of weakness and they tend to open in a sudden uncontrolled fashion, so that the contents squirt out of the container. The reason for this uncontrolled opening is mainly due to the fact that the line of weakness is linear. The linear line of weakness presents the further disadvantage that the first wall breaks right through from edge to edge, even though the line of weakness is not demarcated up to the edges, so that the integrity of the container after opening is compromised.

Other containers of this type are disclosed in the following patents AU19159/83; AU47827/85; AU21286/83; U.S. Pat. No. 3,905,479; GB1572603; AU49661/79; EP81791; EP95335; AU16340/88; U.S. Pat. No. 4,130,245; U.S. Pat. No. 3,453,661; GB1152552; U.S. Pat. No. 4,557,377; U.S. Pat. No. 5,373,966; and U.S. Pat. No. 2,530,400. These containers all suffer from one disadvantage or the other such as that they are relatively expensive, bulky or have limited applications.

OBJECT OF THE INVENTION

It is accordingly an object of the present invention to provide containers and a method for manufacturing containers with which the aforesaid disadvantages can be overcome or at least minimised.

SUMMARY OF THE INVENTION

According to a first aspect of this invention, there is provided a container, which includes a body defining a reservoir, a portion of the body being provided by a first wall having a line of weakness, which is configured to open up to form an opening in the wall when the first wall is folded about the line of weakness, the container being characterised in that the line of weakness is bent.

Further according to the invention, the first wall is resiliently flexible.

Yet further according to the invention another portion of the body is provided by a second wall which is relatively more flexible than the first wall.

The second wall may have a thickness of between 10 and 100 micrometer. Preferably the second wall has a thickness of between 12 and 40 micrometer.

The first wall may have a thickness of between 200 and 600 micrometer. Preferably the first wall has a thickness of between 390 and 430 micrometer.

The container may be in the form of a sachet.

The first wall may be elongate so as to have a longitudinal axis. The first wall may further be rectangular in plan.

The first and second walls may have substantially the same shape and dimensions in outline.

The line of weakness may be orientated so as to extend substantially transversely the longitudinal axis of the first wall.

Alternatively the line of weakness may be orientated so as to extend generally in the same direction as the longitudinal axis of the first wall.

The line of weakness may be positioned substantially in the center of the first wall.

Alternatively the line of weakness may be offset towards an edge of the first wall.

The line of weakness may extend to opposite edges of the first wall.

Alternatively the line of weakness may stop short of opposite edges of the first wall.

The first and second walls may be of a plastics material selected from the group comprising high impact polystyrene, PVC, and PET.

The second wall may be heat-sealed to the first wall.

Further according to the invention the second wall includes an expandable bellows section.

Yet further according to the invention a moisture absorbent pad is located within the reservoir, with the second wall and at least one portion of the first wall being removable from the remainder of the body when the first wall is folded about the line of weakness.

The first wall may be provided with a second line of weakness, the arrangement being such that the second wall and the portions of the first wall outside the two lines of weakness are removable from the remainder of the body.

Further according to the invention the line of weakness is in the form of a groove formation provided in the first wall.

Yet further according to the invention the line of weakness defines at least one apex.

The apex may be defined by a V-shaped angle. The angle may be between 178° and 90°. Preferably the angle is 170°.

Alternatively the apex may be defined by a curve.

According to a second aspect of the invention there is provided a container including a body defining a reservoir, a portion of the body being provided by a resiliently flexible first wall and another portion of the body being provided by a relatively more flexible second wall, the second wall including an expandable bellows section.

The container may be in the form of a sachet.

The second wall may comprise a flexible sheet which is sealingly joined to the first wall.

The second wall may be manufactured from a single strip of elongate flexible sheet, with opposite edge portions of the strip being folded inwardly so as to define the bellows section.

Further according to the invention, the first wall is provided with a bent line of weakness.

According to a third aspect of the invention there is provided a method for manufacturing a container including the steps of:

providing a resiliently flexible first wall;

providing a relatively more flexible second wall;

folding opposite edge portions of the second wall inwardly towards each other to provide a bellows section; and sealingly connecting the second wall to the first wall along its periphery to define a reservoir between the walls.

The method may include the further step of providing a bent line of weakness in the first wall.

The container may have four sides and the step of sealingly connecting the second wall to the first wall may include the steps of sealingly joining the second wall to the first wall along three sides; introducing to the reservoir a substance to be stored in the container; and sealingly joining the second wall to the first wall along the fourth side to seal the container.

BRIEF DESCRIPTION OF THE DRAWINGS

The invention will now be described further by way of example only with reference to the accompanying drawings wherein.

DESCRIPTION OF PREFERRED EMBODIMENTS OF THE INVENTION

Figure 1:
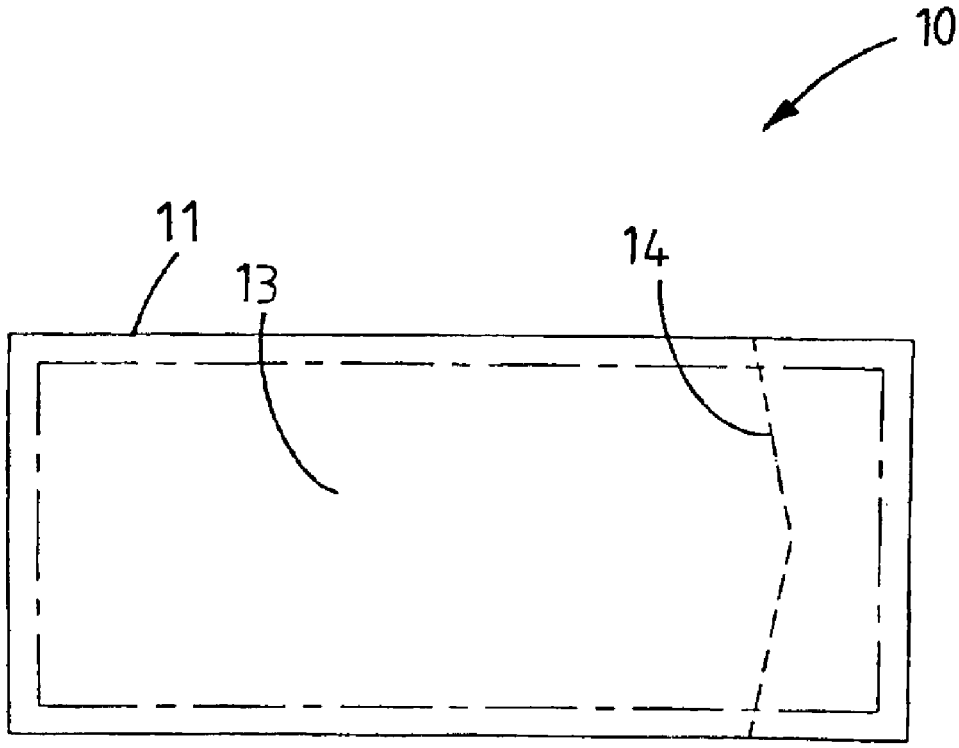
FIG. 1 is a plan view of a container in accordance with a first embodiment of the invention.
Figure 2:
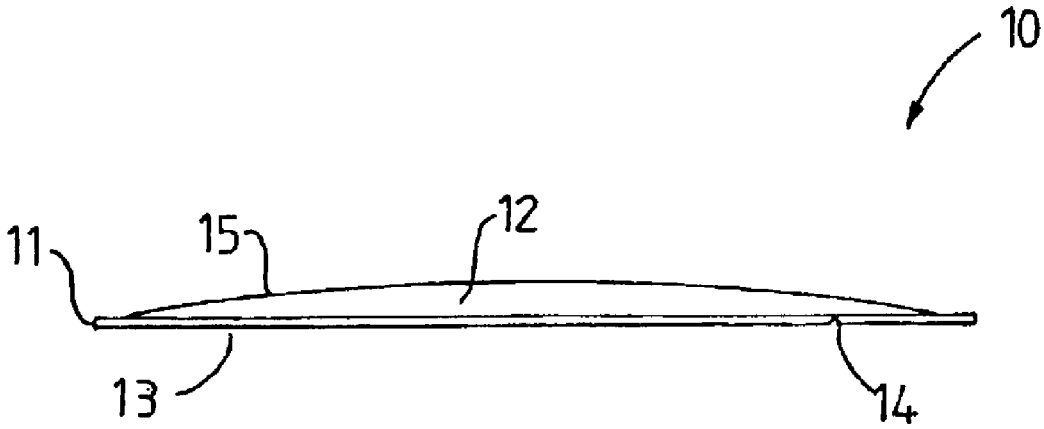
FIG. 2 is a side view of the container of FIG. 1.

In the drawings, same reference numerals are used to denote same or similar parts of features.

A container in accordance with a first embodiment of the invention is generally designated by reference numeral 10 in FIG. 1. The container 10 is in the form of a sachet having a body 11 defining a reservoir 12, a portion of the body 11 being provided by a resiliently flexible first wall 13 having a bent line of weakness 14, and another portion being provided by a relatively more flexible wall 15. The line of weakness 14 is configured to open up to form an opening 20 (FIG. 5) in the first wall 13 when the first wall 13 is folded about the line of weakness 14.

The second wall 15 is sealingly joined to the first wall 13 along its periphery by heat sealing. The first wall 13 and the second wall 15 have substantially the same shape and dimensions in outline.

Figure 12:
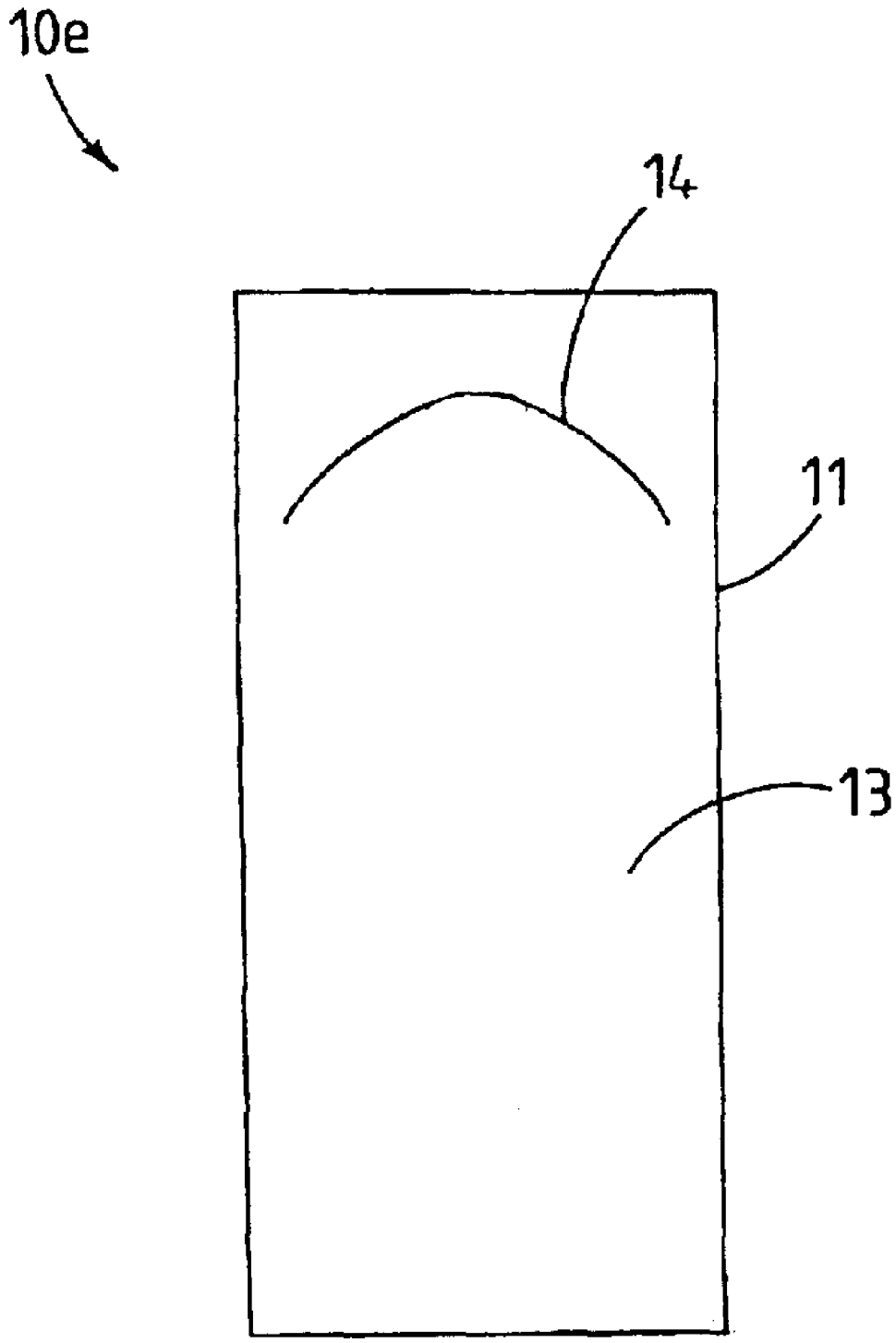
FIG. 12 is a view from below of a container according to yet another embodiment of the invention.

In the first embodiment, the line of weakness 14 is V-shaped. Experiments by the applicant have shown that an angle of not less than 170° provides the most satisfactory breaking and dispensing characteristics. It is envisaged, however, that the angle can be between 178° and 90°. Alternatively, the line of weakness can be curved as shown in FIG. 12. It is also envisaged that the line of weakness can be serrated. The line of weakness 14 is in the form of a shallow groove or cut made into the first wall 13 in conventional fashion known in the art of packaging and plastics.

Figure 3:
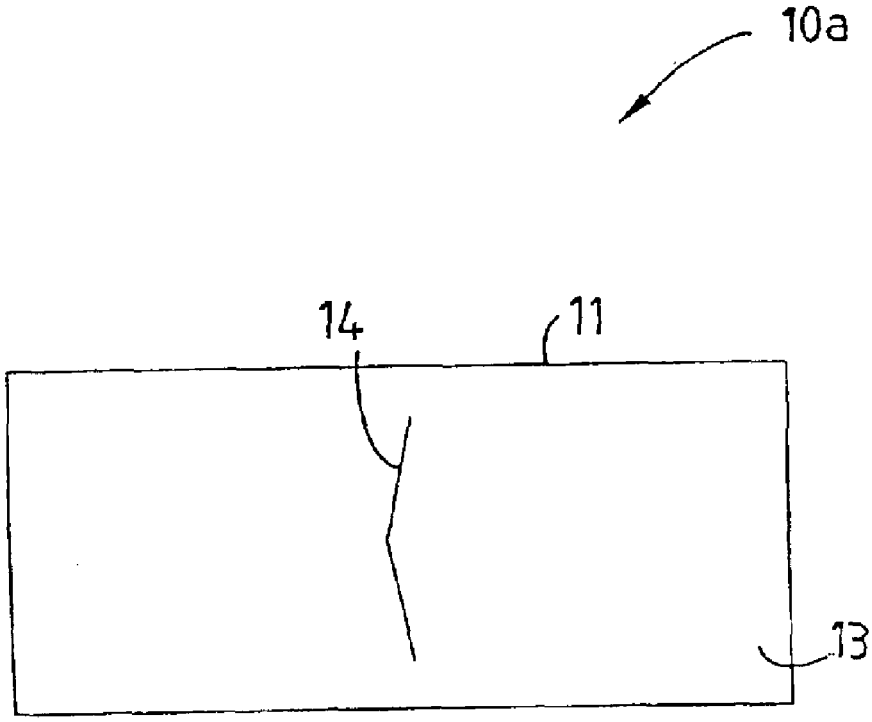
FIG. 3 is a view from below of a container in accordance with a second embodiment of the invention.
Figure 4:
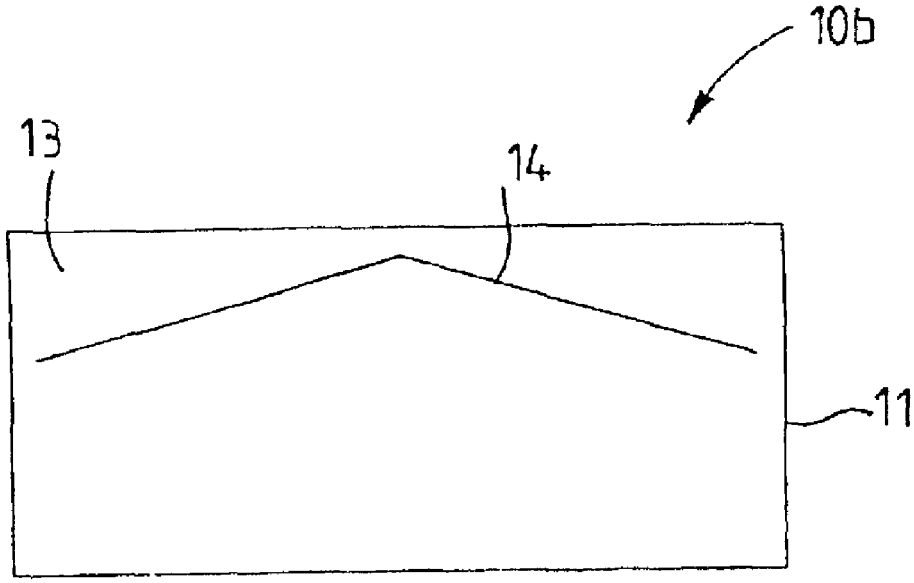
FIG. 4 is a view from below of a container in accordance with a third embodiment of the invention.

The first and second walls 13 and 15 are elongate and rectangular in plan and thus dimensioned so as to have a longitudinal axis. The line of weakness 14 is positioned so as to extend substantially transversely the longitudinal axis of the first wall 13, as shown in FIGS. 1 and 3. Alternatively, the line of weakness 14 can be positioned so as to extend longitudinally along the first wall 13 in generally the same direction as the longitudinal axis of the first wall 13, as shown in FIG. 4.

Depending on the dispensing characteristics required for the application at hand, the line of weakness 14 can either be positioned substantially in the center of the first wall 13, as shown in FIG. 3, or alternatively, offset towards an edge of the first wall, as shown in FIG. 1. The line of weakness 14 can extend right up to the edges of the first wall 13, as shown in FIG. 1. Alternatively, the line of weakness 14 can stop short of the edges of the first wall 13, as shown in FIG. 3, to maintain the integrity of the body 11 after opening. The first and second walls 13 and 15 are of PET. The first wall 13 has a preferable thickness of between 390 and 430 micrometer and the second wall 15 has a preferable thickness of between 12 and 40 micrometer.

In order to provide an opening in the first wall 13, both the first and second walls 15 are folded about the line of weakness 14, by displacing opposite ends of the body 11 towards each other until the first wall 13 opens at the line of weakness 14.

The applicant has found that due to the bent in the line of weakness 14, the first wall 13 opens in a controlled fashion and the container 10 is able to withstand relatively rough handling and a substantial amount of bending, without the first wall 13 opening accidentally along the line of weakness 14.

Figure 5:
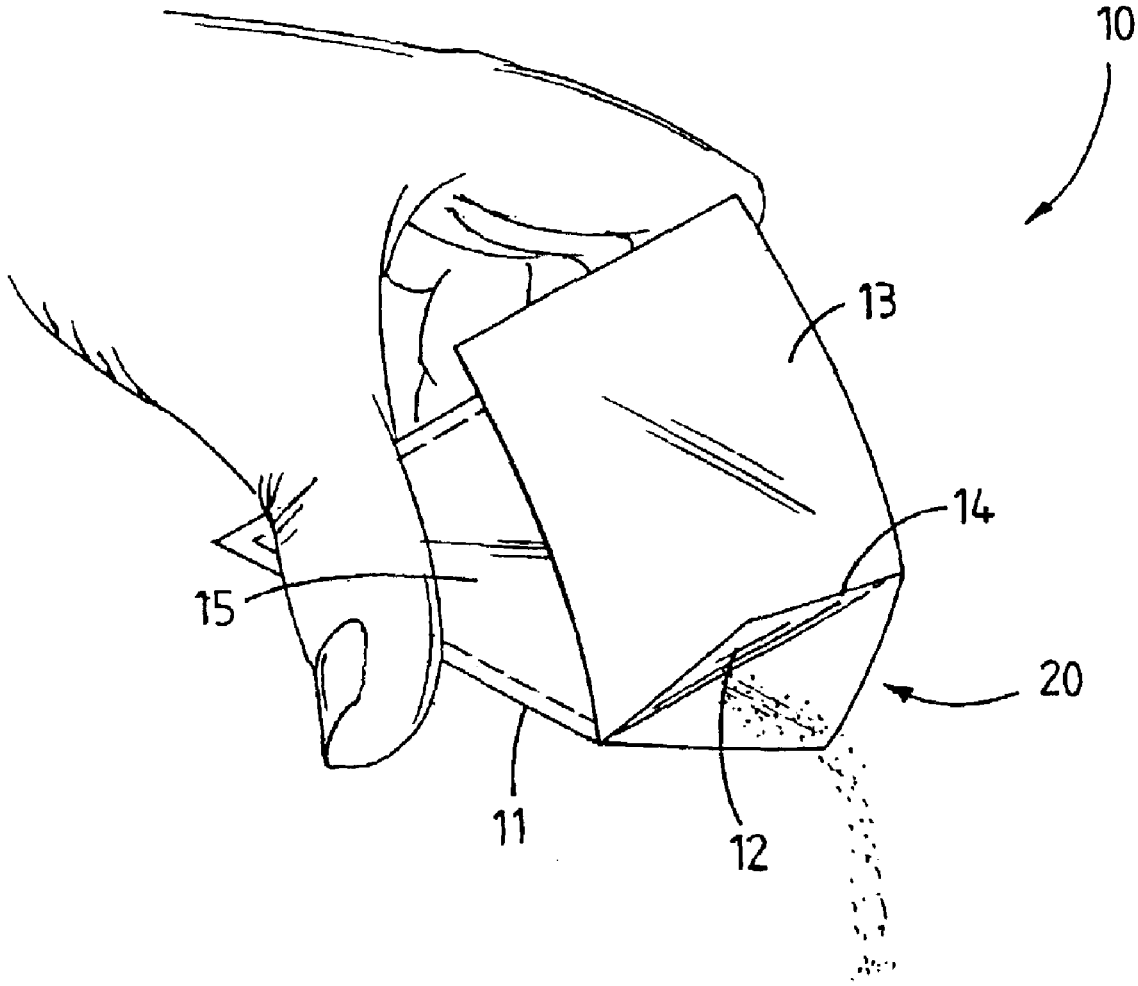
FIG. 5 is a perspective view showing an opening of the container of FIG. 1, for dispensing particulate matter from the container.
Figure 6:
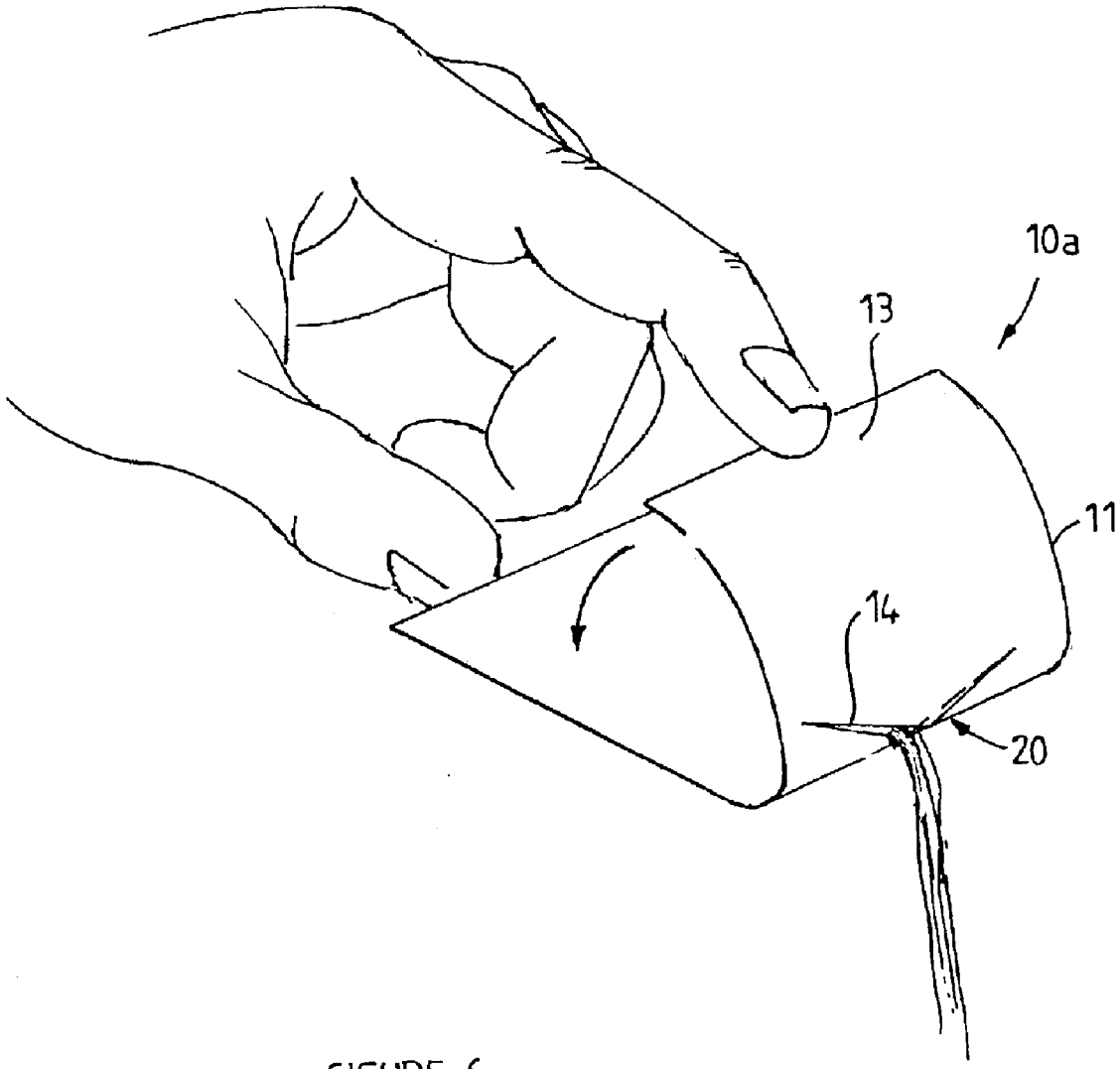
FIG. 6 is a perspective view showing an opening of the container of FIG. 3, for dispensing liquid from the container.

Referring to FIG. 5, after opening, when pressing opposite sides of the container towards each other, the opening 20 forms a spout along the line of weakness 14, thus facilitating pouring of particular matter such as powder from the container 10. Referring to FIG. 6, in the case of the reservoir 12 containing liquids, the opposite ends of the body 11 are pressed together after opening, to squeeze the liquid from the reservoir 12 via the opening 20.

Figure 7:
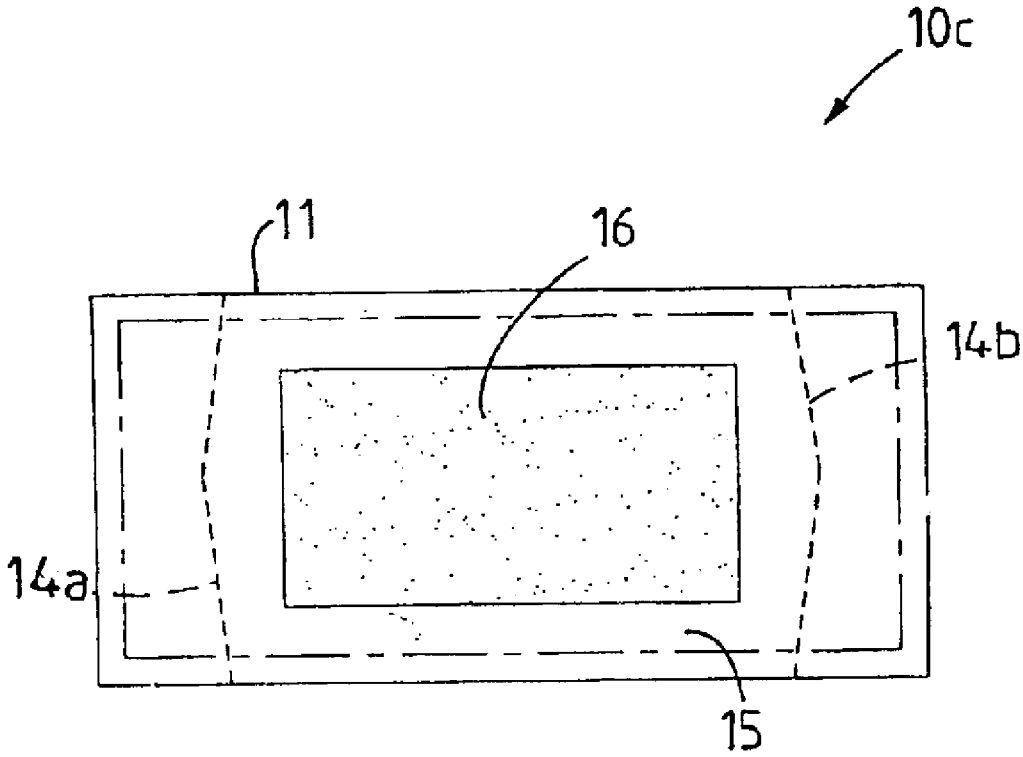
FIG. 7 is a plan view of a container in accordance with a fourth embodiment of the invention.
Figure 8:
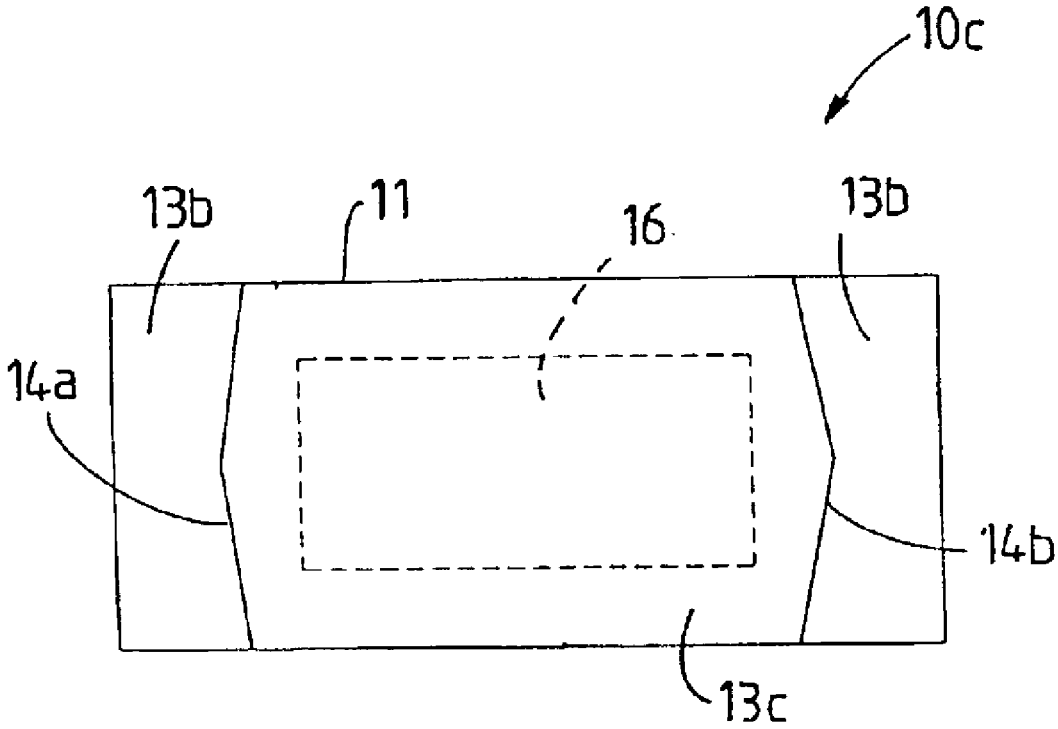
FIG. 8 is a view from below of the container of FIG. 7.

FIGS. 7 and 8 show an embodiment of the invention wherein a moisture absorbent pad 16, such as a sponge, is affixed to a portion of the first wall 13*c* within the reservoir. The first wall 13 contains two lines of weakness 14*a* and 14*b*, one on each side of the moisture absorbent pad 16, with the second wall 15 and the end portions of the first wall 13*b* outside the two lines of weakness 14 being removable from the remainder of the body 11.

Figure 9:
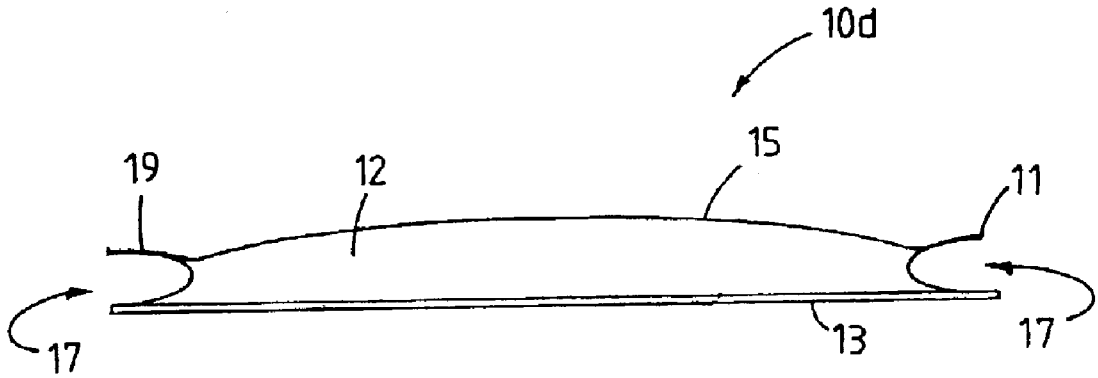
FIG. 9 is a cross-sectional end view of a container in accordance with a fifth embodiment of the invention.
Figure 10:
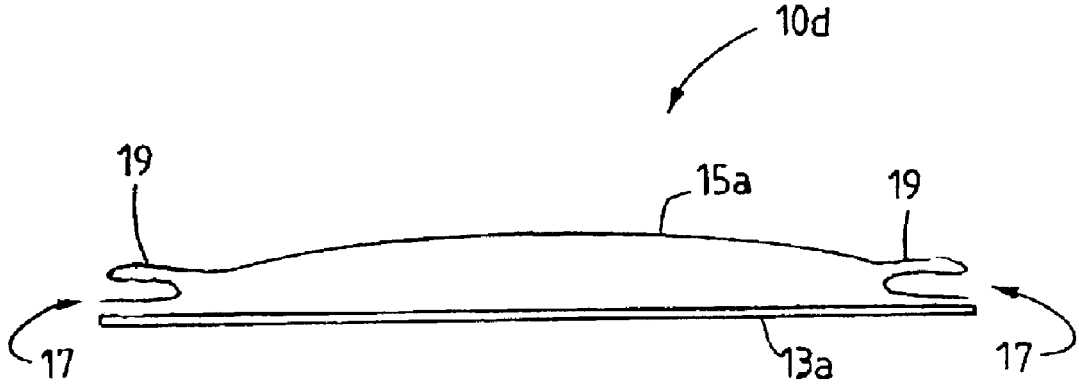
FIG. 10 is a cross-sectional end view illustrating a step in the manufacture of the container of FIG. 9.
Figure 11:
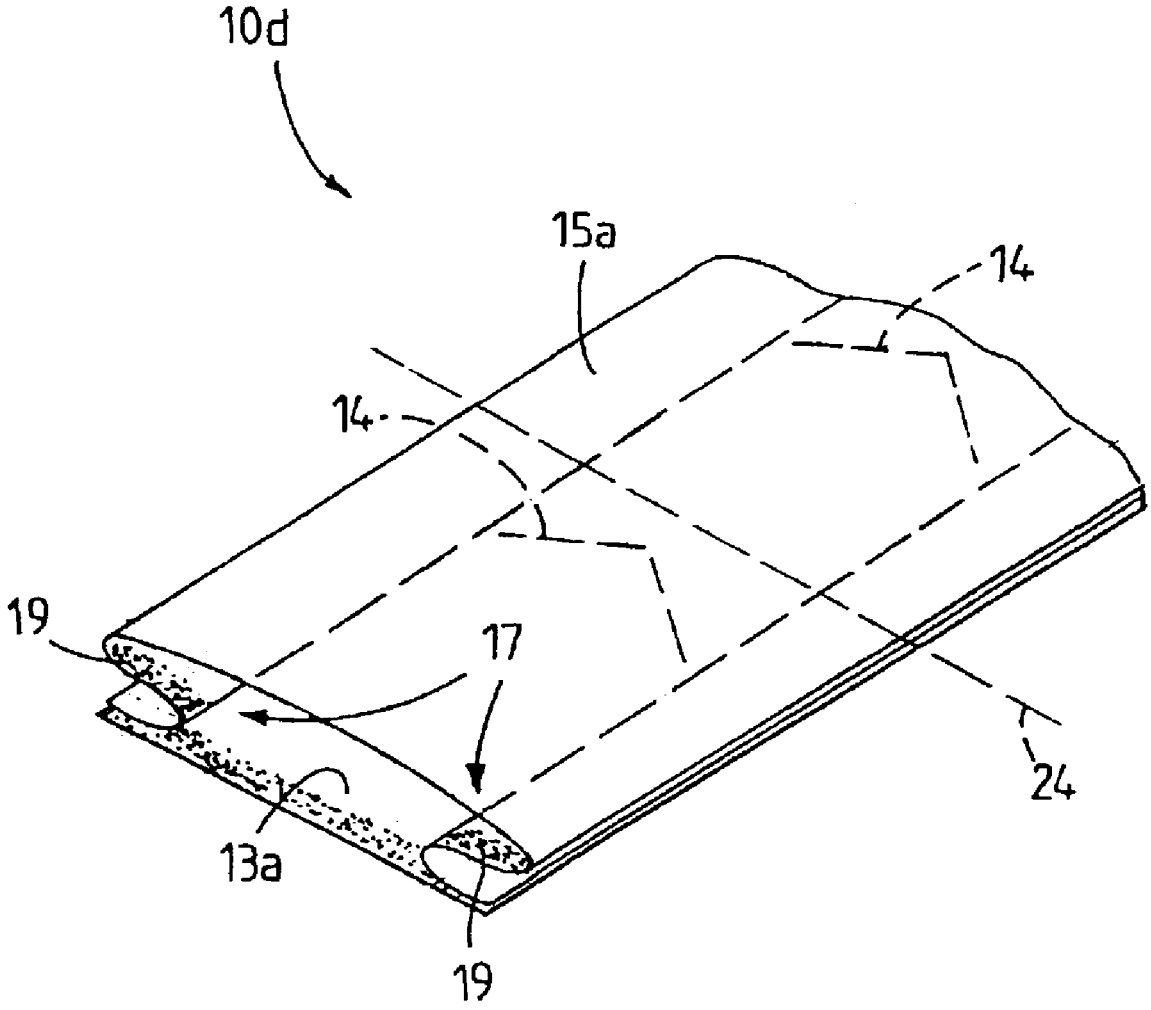
FIG. 11 is a perspective view of FIG. 10.

In another embodiment of the invention, as shown in FIGS. 9 to 11, two opposite sides of the second wall 15 are folded inwards to define an expandable bellows section 17.

The applicant has found that a container 10*d* provided with such bellows section 17, has a surprisingly larger capacity than a similar container having the same outer dimensions in plan, and not provided with such bellows section.

As shown in FIGS. 10 and 11, the container 10*d* is manufactured form a first elongate strip 13*a* of resiliently flexible PET and a second elongate strip 15*a* of relatively more flexible PET. A method for manufacturing the container 10*d* includes the steps of:

folding opposites edge portions of the second strip 15 inwardly to define the bellows section 17;

heat sealing the inside of the second strip 15*a* to the inside of the first strip 13*a* along three sides, to define a reservoir 12;

at the same time, heat sealing the portions 19 of the bellows section 17 where the inside surface of the second sheet 15*a* overlaps, to each other;

filling the reservoir 12 with suitable contents;

heat sealing the second strip 15*a* to the first strip 13*a* along a fourth side to seal the reservoir 12, to form a container 10*d*; and cutting the container 10*d* from the rest of the first and second strips 13*a* and 15*a* along line 24.

It will be appreciated that the lines of weakness 14 are formed in the first strip 13*a* prior to the sealing step.

In another embodiment of the invention shown in FIG. 12, the apex of the line of weakness 14 is defined by a curve.

It will be appreciated that many variations in detail are possible with a container and method for manufacturing a container according to the invention without departing from the scope of the appended claims.

What is claimed is:

1. A container, which includes:

a body defining a reservoir;

a portion of the body being provided by a first wall, the first wall being resiliently flexible and having a thickness of between 200 and 600 micrometer; and another portion of the body being provided by a second wall which is relatively more flexible than the first wall and having a thickness of between 10 and 100 micrometer;

the first wall having a line of weakness, which is configured to open up to form an opening in the first wall when the first wall is folded about the line of weakness, the line of weakness being in the form of a continuous groove formation provided in the first wall; and the container being characterised in that the line of weakness is bent to define a V-shaped angle of between 178° and 90°, such that the first wall opens in a controlled fashion when folded about the line of weakness.

2. A container according to claim 1, wherein the second wall has a thickness of between 12 and 40 micrometer.

3. A container according to claim 1, wherein the first wall has a thickness of between 390 and 430 micrometer.

4. A container according to claim 1, wherein a moisture absorbed pad is located within the reservoir, with the second wall and at least one portion of the first wall being removable from the remainder of the body when the first wall is folded about the line of weakness.

5. A container according to claim 4 wherein the first wall is provided with a second line of weakness, the arrangement being such that the second wall and the portions of the first wall outside the two lines of weakness are removable from the remainder of the body.

6. A container according to claim 1, wherein the angle is 170°.

7. A container according to claim 1, wherein the container is in the form of an elongate sachet having a longitudinal axis and wherein the line of weakness is oriented so as to extend generally in the same direction as the longitudinal axis of the first wall.

8. A container according to claim 1, wherein the line of weakness extends to opposite edges of the body.

9. A container according to claim 1, wherein the line of weakness stops short of opposite edges of the body.

10. A container according to claim 1, wherein the second wall includes an expandable bellows section.

11. A container according to claim 1, wherein the first wall further comprises a second line of weakness independent of the first line of weakness, wherein the second line of weakness forms a second opening when the first wall is folded about the second line of weakness.

* * * * *